US007212780B2

(12) United States Patent
Weinlich et al.

(10) Patent No.: US 7,212,780 B2
(45) Date of Patent: May 1, 2007

(54) PROCESS AND DEVICE FOR SUPPLYING SUBSTRATES IN A PRINTING UNIT

(75) Inventors: Uwe Weinlich, Kiel (DE); Eckhard Bauer, Kiel (DE); Jörg Leyser, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 193 days.

(21) Appl. No.: 10/457,878

(22) Filed: Jun. 10, 2003

(65) Prior Publication Data

US 2004/0047661 A1 Mar. 11, 2004

(30) Foreign Application Priority Data

Jul. 29, 2002 (DE) ..... 102 34 629

(51) Int. Cl.
*G03G 15/00* (2006.01)

(52) U.S. Cl. ..... 399/394; 399/396

(58) Field of Classification Search ..... 399/394, 399/396; 271/270, 261, 258.01, 259, 265.01, 271/265

See application file for complete search history.

(56) References Cited

U.S. PATENT DOCUMENTS 4,416,534 A * 11/1983 Kluger ..... 399/396
4,455,018 A * 6/1984 Colglazier et al. ..... 271/227
4,505,772 A * 3/1985 Renz ..... 156/355
4,669,853 A * 6/1987 Sosinski et al. ..... 399/11
4,844,436 A * 7/1989 Jaton ..... 271/34
5,022,644 A * 6/1991 Burge ..... 271/270
5,090,676 A * 2/1992 Matsuno et al. ..... 271/12
5,096,183 A * 3/1992 Hauck et al. ..... 271/227
5,313,253 A * 5/1994 Martin et al. ..... 399/16
5,461,468 A * 10/1995 Dempsey et al. ..... 399/396
5,574,527 A * 11/1996 Folkins ..... 399/9
5,579,092 A * 11/1996 Isobe et al. ..... 399/39
5,613,675 A 3/1997 Kruger et al. ..... 271/270
5,983,066 A * 11/1999 Abe et al. ..... 399/394
6,370,354 B1 * 4/2002 Chapman et al. ..... 399/394
6,505,832 B2 * 1/2003 Moore et al. ..... 271/265.01
2002/0012037 A1 1/2002 Angst et al. ..... 347/104

FOREIGN PATENT DOCUMENTS

DE 195 09 468 A1 9/1996

* cited by examiner

*Primary Examiner*—Anthony H. Nguyen
(74) *Attorney, Agent, or Firm*—Lawrence P. Kessler

(57) ABSTRACT

Preparing substrates for one-sided or two-sided printing in an electrophotograpically operated digital printing apparatus, in which process substrates are fed out of a supply unit or several supply units onto a conveyor operation sequence and are transferred, preferably in the course of the conveyor operation sequence, onto a conveyor belt that runs through a printing unit, with the least possible space between successive substrates. An acceleration time related to the type of substrate stock, of which the substrate is composed, is selected for feeding a substrate from a supply unit or from the supply unit.

12 Claims, 1 Drawing Sheet

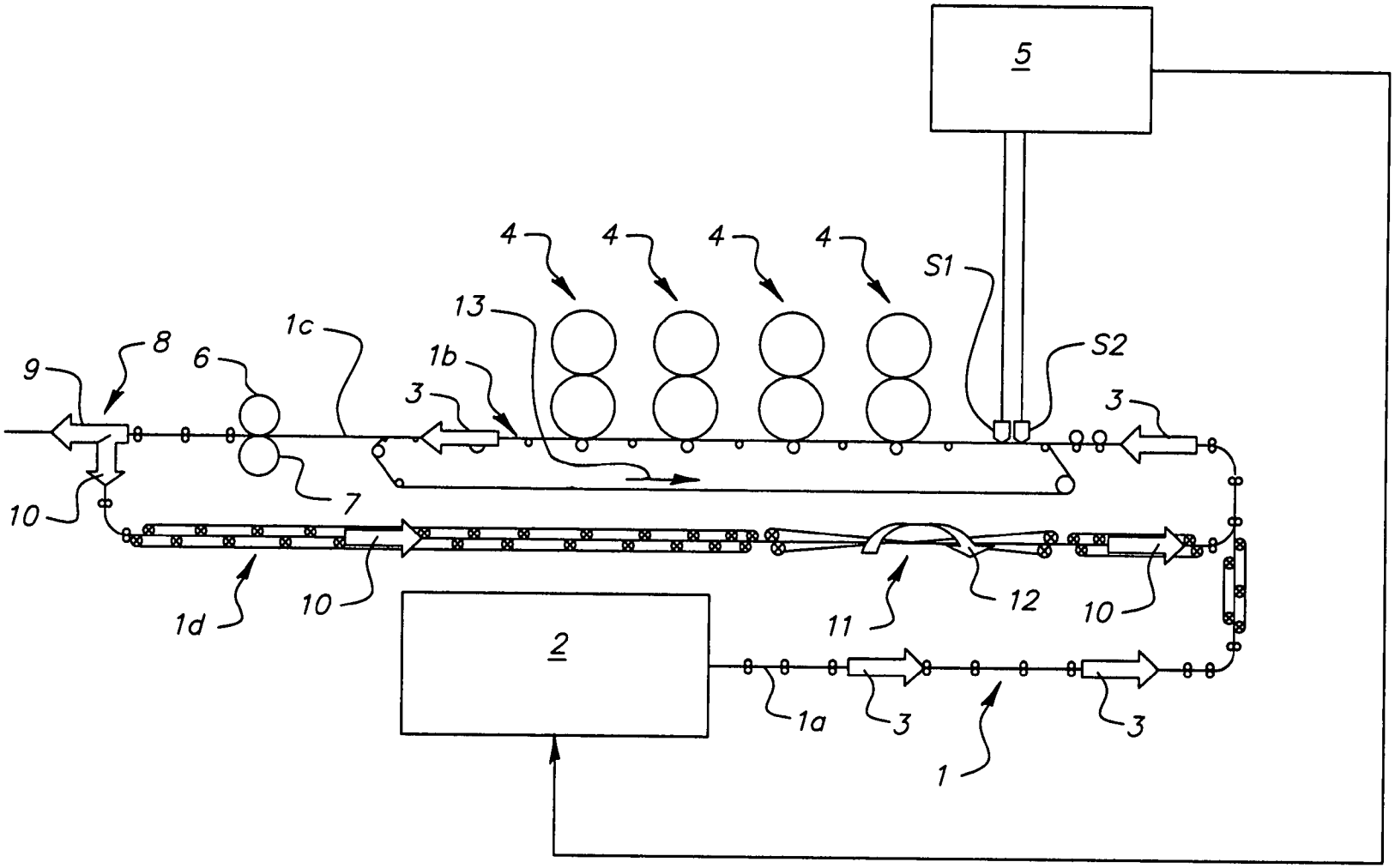
FIGURE

PROCESS AND DEVICE FOR SUPPLYING SUBSTRATES IN A PRINTING UNIT

FIELD OF THE INVENTION

The invention relates in general to supplying substrates for one-sided or two-sided printing (simplex, duplex, face- and reverse sides) in a printing apparatus, preferably in an electrophotograpically operated digital printing apparatus, in which process substrates are fed out of a supply unit or several supply units (feeders) onto a conveyor operation sequence and are transferred, preferably in the course of the conveyor operation sequence, onto a conveyor belt (web) that runs through a printing unit, in particular with the least possible space between successive substrates.

BACKGROUND OF THE INVENTION

A device and a process supplying substrates to an electrophotographically operated digital printing apparatus are well known from DE 100 23 828. With an electrophotographically operated digital printing apparatus that, for the sake of clarity, will be more closely explained, but without limitation to such a printing apparatus, substrates to be printed are supplied from one or more conveyor operating sequences to a paper path, or more generally to a conveyor operating sequence for substrate stock of any kind. The presence of several feeders or supply units makes it possible to supply substrate stock particularly of various formats, weights, materials, or the like. This is an advantage above all in the case of a digital printing apparatus because every single page to be printed is illustrated anew anyway. Therefore, it is also possible to reduce time for printing jobs where, for example, a single such printing job consists of pages of a brochure that are supplied to the printing apparatus one right after another and, subsequently, if the occasion arises, are also finished, in such a way that the front and back cover could be a heavier paper and following pages a lighter paper. In between, perhaps, even film with graphs or the like could be printed. These varying substrate stocks would be in different feeder units and in a previously selected sequence fed respectively as substrates in the conveyor operating system intermittently at a certain rate.

Thus, an initial section of a conveyor operating sequence beginning with the feeder units can consist, for example, of clamping belts propelled along a closed loop path, between which the substrates are conveyed. Afterwards, the substrates can be transferred and fed onto a conveyor belt powered to revolve and adhered there through electrostatic force. This conveyor belt is mostly a transparent plastic belt and leads through a printing unit that can, of course, exist for color printing from several printing devices. In electrophotographic printing a latent toner image per color extract is transferred to the substrates. Afterwards, the substrate is carried on to a fixer unit, in which the toner image is bonded to the substrate, in particular superficially fused and cooled down. A change of agency of conveyance in the conveyor operating sequence could take place for conveyance into and through the fixing unit. Thereafter, substrates to be printed on only one side will be conveyed further or released into a feeder. After fixing, substrates to be printed on both sides will be conveyed back over a conveyor operating sequence loop to the printing unit and reversed for further printing. The return transport and turning can occur simultaneously in that the clamp belts can be utilized again for this section of the conveyor operating sequence. They take a certain helixoid spiral course and therefore turn the substrates by 180° around the longitudinal axis in the transfer direction in which they are moving.

In particular, the conveyor belt feeding through the printing apparatus, the belt that frequently is labeled web in electrophotography, should be clogged with the least possible spacing between substrates in order to have the fastest possible flow rate, and thus ensure the greatest possible print production. On the other hand, the least possible spacing between successive substrates must be observed. This is true both for one-sided printing of the front sides of substrates, and also in the case of two-sided printing for printing the front sides and the reverse sides of substrates in face-and-reverse printing.

In order to achieve the optimal or best aligned allocation of the web possible, the web is theoretically or even through control systems separated into fields that can be designated as frames, in which a substrate, taking established formats into consideration, should be precisely placed for printing in each case. In that way, where there is a crisscrossing seam by which the ends of the web are bound, a field of the web is recessed in order to shape the web as a closed loop. For convenience, this seam is otherwise also used as a marker and recorded by a sensor, in order to be able to monitor the status of circulation of the web and to have a point of reference. For that reason, this seam may not be covered. Other markers would also come into consideration, of course, particularly those that are only marginally mounted on the web.

The elapsed time of the runback after printing of the first side of revolving substrates and the elapsed time of the web should stand in an integer relationship to one another so that, after return transport of the substrates, these frames are also encountered once again properly on the conveyor belt for transfer of the substrates for two-sided printing.

For all that, problems can still arise in that the substrate run times can be influenced by multiple parameters within the printing apparatus. As an example, weight and length of paper emerged as commanding paper-related influences. Similarly, machine specific parameters, e.g. precise length of the conveyor operation sequence, roll diameter, and motor speed contribute thereto.

This process is the reason for various problems affecting the run time of the printing apparatus (e.g. image quality, inadequate paper pitch). Especially noteworthy is the problem that arises on print work orders with mixed types of paper. Thus, for example, thick (heavy) sheets have shorter run times than thin sheets. For that reason, the pitch of two back-to-back substrates can lessen significantly during the flow through the apparatus (the quicker, thick one picks up). That leads then to an interruption of the printing operation because of inadequate distance between sheets and with that to a significant output loss for the apparatus. Similarly, substrates can possibly come to rest on the web-seam and thereby subject to image defects.

Thus the problem of presenting a process or a device of the kind mentioned is the basis for the invention, a process or a device that is capable of better supplying substrates.

SUMMARY OF THE INVENTION

Accordingly, this invention provides that a start time, based on the type of substrate stock that makes up the substrate, is selected for supplying a substrate from one of the feeder units. Thus, according to the invention, substrates are advantageously started (that is, fed from the respective supply unit onto the conveyor operation sequence) at different times depending upon their type, particularly length and/or weight. The purpose is to compensate in advance in this way for the misplacements of substrates that are to be expected during conveyance, especially with one another, and thus to affect the substrates from the opposite direction so that, they are situated in the desired position during conveyance.

In order to be able to carry out such pilot control in a targeted way on a large scale, after further development of the invention, the intent is to gain information for selecting the start time in advance by at least one test run with at least one type of substrate stock, preferably by test runs with different types and with production of an appropriate empirical table, for example in the form of a reference table.

The substrate registered in this way can be corrected with respect to its situation only by subsequent treatment. That remains essentially out of consideration in the framework of the present invention, except for a possible return run for printing a reverse side, a topic that will be treated later in greater detail. In the framework of the present invention, the registration of the oncoming substrate should serve primarily to utilize the information gained by the sensor for at least one substrate that is still in the same supply unit from which the registered substrate came, and that is the one to be fed onto the conveyance path next. For this substrate, a better start time can be selected based on the sensor information, for example by regulating such a start time, or by the appropriate correction of a type-dependent universally assigned start time, for example, that is already available, to bring it about that the newly corrected substrate comes in more precisely than the substrate registered beforehand.

A time difference determined with the information from the sensor is preferred for such an improvement. The information again reflects an arrival error in such a way, namely, that the time deviation between the registered arrival time (IST-time point) of the registered substrate and the anticipated time point calculated from its start time (SOLL-time point) is determined. It is used as a correction value for correcting the start time for feeding at least the next following substrate that is still located in the same supply unit out of which the registered substrate originates from this supply unit into the conveyance path.

The invention, and its objects and advantages, will become more apparent in the detailed description of the preferred embodiment presented below.

BRIEF DESCRIPTION OF THE DRAWING

In the detailed description of the preferred embodiment of the invention presented below, reference is made to the accompanying drawing, in which:

An operational example of a print apparatus conveyance path, to which the invention is not limited in its extent, is portrayed schematically, in the sole FIGURE, in a side view merely as an example.

DETAILED DESCRIPTION OF THE INVENTION

Referring now to the accompany drawing, the conveyance path 1 begins at a feeder unit or several feeder units that are indicated together schematically only as block 2. From there substrates are supplied to the conveyance sequence in the conveyance direction in accordance with arrow 3, that is started particularly at a determined start time point. A first section of the conveyance sequence 1*a* ends in front of a circulating conveyor belt that forms a second conveyance sequence section 1*b* and onto which the substrates are fed in order to travel across a print unit of the print apparatus with, in this case, four color print stations 4.

Approximately in the transfer area of the first to the second section of the conveyor sequence 1*a*, 1*b*, there are two sensors S1 and S2 set up. Sensor S1 recognizes a transverse joint of the conveyor belt as marking this conveyor belt. Sensor S2 recognizing the arrival of a substrate. Both sensors are connected to control unit 5 to send sensor signals thereto. The control unit 5, according to the invention, exercises influence on the feeder unit or feeder units 2. Preferably from an information signal out of S2, with consideration of an information signal out of Sensor S2, the control unit 5 determines or corrects a start time point for at least one substrate to start next from the feeder unit 2.

After the substrates pass by print stations 4 and their front sides are printed, the substrates are transferred to a third conveyor sequence section 1*c* to be fed to a fixing unit with a fixing roller 6 and a counter-pressure roller 7. After fixing, the substrates reach a path switch 8. Substrates to be printed on one side only are conveyed in the direction of arrow 9 to an arm (output device, for example) that is not shown. Substrates to be printed on both sides are directed in the direction of arrow 10 into a return path 1*d*. The return path 1*d* conveys the substrates back in front of the print unit into the range of sensors S1 and S2. The return path 1*d* includes a turning mechanism 11 with which the substrates are rotated 180° around their longitudinal axes, as indicated with arrow 12. This enables the substrates to be returned to path 1*b* with the opposite side available to be printed upon (duplex printing). Meanwhile, the empty branch of the endless conveyor belt 1*b* moves in the direction of the arrows 13.

In particular, according to the invention, substrates following one another that originate from the same supply unit are always regulated, while substrates from different supply stations are not brought into relationship with each other, at any rate not through regulation, although with a view to the total result to be obtained, even if those sorts of substrates are present together and successively in conveyor sequence for a mixed print job.

If the registered substrate alone is from an ascertained supply unit and if no substrate follows it from the same supply unit onto the section of the conveyance route between the sensor and the supply unit, then the evaluation of the sensor for this substrate is taken only to start at least the next substrate from the same supply unit. Then, however, the total time difference of the substrate registered alone should not be taken for the correction of the substrate to be started because this one does not have to represent all substrates. As a precaution only a part of the measured time error is considered for the start time of the substrate to be started, for example 80%, so as not to over-manage substrate start timing. The algorithm described here is namely to be taken as a starting algorithm. By it, a correction of the course of the substrate at the start of the print apparatus should occur without oscillation of regulation even if somewhat roughly, and assuredly as iterated to the desired value as possible.

This is then also valid although several substrates originate from the same supply unit at the start. However, the time errors measured in each case can then still be averaged across existing substrates. This leads to a reliable correction of the start time points for the remaining substrates to be started, according to the invention after further development, in this way. If several substrates originating from the same supply unit are in the conveyor path section between the supply unit and the place of the sensor (S2) at the time of registration of the arrival time of the first of these substrates near the substrate reaching the sensor, for this first registering substrate and for the successive substrates from the same supply unit that are in the section of the conveyor path, in each case the time deviation between the registered arrival time (IST-time-point) of this registered substrate and the anticipated arrival time (SOLL-time-point) calculated from the start time point of the registered substrate, determines and is used as a correction value to correct the start time point for supplying at least one following substrate that is then still in the same supply unit where the registered substrate originated, but the value is divided in each case by the number n1 of the substrates from this same feeder unit that are in the conveyor path section.

Nevertheless, in order to maintain the speed of the start algorithm described, the time difference of all the substrates from the same feeder unit will not be considered for correction where too great a number of substrates is present in the section of the conveyor path; rather, then it is preferably planned that the number n1 of the substrates from this feeder unit that are in the section of the conveyor path will then be taken as a divisor, only if it does not exceed an established maximum number n2 that is an element outside the quantity of natural numbers, and this maximum number n2 is taken as divisor instead of the actual number n1. In this case n2 could be set, for example, equal to 3.

Thus it is planned then that only those successive substrates in the section of the conveyor path that are following the first registered substrate are taken for calculation of correction values. Their current number, counted from the first registered substrate is equal to or smaller than the established maximum number n2, while the other successive substrates with a current number greater than n2 and equal to or smaller than n1 remain out of consideration for correction of substrates newly feeding out of the feeder unit.

If the print apparatus is started and the paper flow calibrated by means of the algorithm described, the print machine is preferably changed over in its subsequent enterprise to a more dynamically operating algorithm as enterprise algorithm that distinguishes itself by independently solving the problem in the following manner. The time deviation between the registered arrival time (IST-time point) of a substrate arriving respectively at the sensor (S2) and the arrival time point that can be expected (SOLL-time point) calculated from its start time point determines, and is used as, correction value to correct the start time point or to correct a correction value already planned to correct this start time point for feeding the substrate foreseen as the next substrate still in the same feeder unit from which the registered substrate originates onto the conveyor path. It is nevertheless still divided by the number n1 of the substrates from the same supply unit that are directly in the section of the conveyance path along with the respectively registered substrate.

This change over in the enterprise algorithm occurs preferably after the substrates of the numbers n2+1 to n of the start algorithm that are not considered for correction have passed the sensor. However, over control and rule oscillation are also to be avoided, which is reached preferentially by the fact that a determined value n3, the element from the quantity of natural numbers is taken in place of the number n1 in the event that n1 is equal to or smaller than n3.

Since the conveyance path of a substrate to be printed on both sides is different from that of a substrate to be printed on one side only, specifically the return path is added to the conveyance path, according to the invention it is anticipated with advantage for substrates to be printed on both sides in independent solution of the problem that a start time point for feeding a substrate intended for two-sided printing is selected from a feeder unit or the feeder unit other than one for a substrate from the same feeder unit intended for printing only on one side.

Even the run-time errors that presumably will occur during the return can be compensated for in advance according to the invention. Type of printing stock also can be considered with respect to this compensation.

If it should be established by the sensor during registration of the arrival times of these substrates to be printed on both sides that, despite prior compensation, a run-time error remains, then this return path should nevertheless be compensable according to the invention. To that end an independent further development of the invention anticipates that a group of substrates to be printed on both sides is conveyed back and turned in the direction toward the printing unit in each case after printing of their first side for printing of their respective second sides. In this way a velocity or a change in velocity is imparted that is adapted to correct misplacement of these substrates vis-à-vis a SOLL-position or at least to decrease it.

With these measures according to the invention the entire group—it can also be designated a block—is considered as substrates in return. In addition it is to be considered that substrates to be printed on one side can be urged through the print apparatus quasi continuously because the conveyance path is so to speak open-ended. At the same time on account of the limited capacity of the return path, a reverse-side printing can occur only in a group or block-by-block. Therefore, as already stated previously, the circulation through the return path has to be coordinated in integral relationship with the circulation of the conveyor belt (web). To this end, consideration of substrates by groups is therefore proper. A run-time correction related primarily to the middle error of the group should occur, and sometimes even independently of whether or not a start time correction of the individual substrates has taken place.

Moreover, the start algorithm and the operating algorithm can also be regarded mainly as independent of whether or not the start time point of a substrate for a planned two-sided printing was or was not corrected in this regard, because the actual start point time can be considered under these other algorithms. The system can at any time "know" the actual start time points respectively and the number of starts that have taken place, and can consider them in evaluating the sensor.

Thus, delaying or protracting substrates for their correction can be planned right on the return path. According to the invention this is, of course, also mainly conceivable in other conveyance sections, also particularly in addition to or as an alternative to a change of the start point time of a substrate. However, a change of start point time is possible more simply by software without complicating and further burdening the mechanism. In fact let it be mentioned here once more that the proper arrival time or substrate distance is, of course, the objective, no matter how it is reached in the long run.

In order correctly to adjust the critical return path in relation to a minimum distance for substrates to be printed on both sides, in particular to keep the print stock from backing up, it can be planned that the conveyance path intended for the return path is equipped with at least one substrate less for a test run than is planned after testing for the following runs.

For a device of the kind initially specified, that is distinguished by independently solving the problem posed in that at least one sensor (S2) for registering the arrival point of at least one substrate of at least one substrate is planned at the location of the conveyor path designated by the sensor (S2). It is also distinguished by the fact that the sensor (S2) is effectively connected with a control unit that by the registered arrival time gives, or corrects, a start time point and/or the travel velocity for feeding at least a next following substrate that is still in the same feeder unit from which the registered substrate also originates. Independent protection is also claimed from this feeder unit onto the conveyance path and/or also on the conveyance path.

Let it be indicated here once again that the previously mentioned values n1, n2, and n3 can be adapted in the long run to the mechanical characteristics of the print unit, in particular to the available distances, the desired apparatus behavior and/or the desired rate of change of corrections.

The invention has been described in detail with particular reference to certain preferred embodiments thereof, but it will be understood that variations and modifications can be effected within the spirit and scope of the invention.

What is claimed is:

1. A process for supplying substrates for one-sided or two-sided printing in an electrophotographically operated digital printing apparatus, in which substrates are fed from at least one supply unit to a conveyor and transferred, in the course of the conveyor operation sequence, onto a belt that runs through a printing unit of the digital printing apparatus, the process comprising:

selecting successive points in time for acceleration of substrates from said at least one supply unit for supplying substrates, with the least possible space between successive substrates, depending on the type of print stock of such substrates, wherein the arrival time of at least one substrate at a particular place on the belt is detected by a sensor and designated through a signal from the sensor, and by this arrival time for this detected substrate, the point in time for a successive substrate is selected for supplying such successive substrate, that is still in the same supply unit from which the detected substrate originates, from this supply unit to the belt.

2. The process according to claim 1, wherein a time deviation between the arrival time of a detected substrate and an anticipated arrival time calculated from its point in time for acceleration, determines, and is used as, a correction value for correction of the point in time for acceleration for supplying a successive substrate from the same supply unit from which the detected substrate also originates, from this supply unit to the belt.

3. The process according to claim 2, wherein only a portion of the calculated time deviation is used as the correction value for correction of the point in time for acceleration for a successive substrate from the same supply unit from which the detected substrate originates, from this supply unit to the belt.

4. The process according to claim 1, wherein when several successive substrates from the same supply unit are in the section of the belt between the supply unit and the location of the sensor for detecting the detected substrate at the point in time of the arrival time of the first of these substrates to reach the sensor, for this first registered substrate and for the successive substrates from the same supply unit that are on the belt, respectively, the time deviation between the registered arrival time of this first substrate and the anticipated arrival time calculated from its point in time for acceleration determines, and is used, as the correction value for correcting the point in time for acceleration for feeding a successive substrate that is at the time still in the same supply unit from which the detected substrate originates, divided by the number (n1) of the several successive substrates from this same supply unit.

5. The process according to claim 4, wherein the actual number (n1) of the successive substrates from this supply unit that are on the belt is taken only as a divisor if it does not exceed a specified maximum number (n2), which is an element from the quantity of natural numbers, and if this maximum number (n2) is otherwise taken as divisor instead of the actual number (n1).

6. The process according to claim 5, wherein only the successive substrates on the belt that follow the first detected substrate, whose constant number, counted from the first detected substrate, is equal to or greater than the specified maximum number (n2), are taken for calculation of correction values, while the further successive substrates with a constant number greater than the specified maximum number (n2), and smaller than or equal to the actual number (n1), remain out of consideration for a correction value for substrates to be newly fed from the supply unit.

7. The process according to claim 6, wherein the process is used only when starting the printing unit.

8. The process according to claim 6, wherein a determined value (n3), that is an element from the quantity of natural numbers, is taken as divisor instead of the actual number (n1) wherein 1 is equal to or smaller than the determined value (n3).

9. A process for supplying substrates for one-sided or two-sided printing in an electrophotographically operated digital printing apparatus, in which substrates are fed from at least one supply unit to a conveyor and transferred, in the course of the conveyor operation sequence, onto a belt that runs through a printing unit of the digital printing apparatus, the process comprising: selecting successive points in time for acceleration of substrates from said at least one supply unit for supplying substrates, with the least possible space between successive substrates, depending on the type of print stock of such substrates, wherein, the manner of selecting a time point for acceleration for supplying a substrate, intended for two-sided printing, differs from a time point for acceleration for a substrate from the same supply unit intended for single-sided printing.

10. The process according to claim 9, wherein the difference between a time point for acceleration for a substrate to be printed on two sides and a time point for a substrate to be printed on one side is chosen based on the type of substrate stock.

11. The process according to claim 9, wherein a group of successive substrates, to be printed on both sides after the printing of their respective first sides, is respectively transported and turned in the transfer direction to be returned in front of the printing unit for printing of their second sides, and in this way a velocity is given that is suitable for correcting, or at least reducing, a misplacement of these successive substrates with respect to an anticipated arrival time, at least within such group.

12. The process according to claim 11, wherein the transport route for the return of such successive substrates accommodates a test run with at least one substrate less than is planned for the runs following the test run.

* * * * *